US011478909B2

(12) United States Patent
Lai

(10) Patent No.: US 11,478,909 B2
(45) Date of Patent: Oct. 25, 2022

(54) WARNING APPARATUS OF AN EXTENSIVE SHAFT FOR A TORQUE TOOL

(71) Applicant: Shih-Hao Lai, Taichung (TW)

(72) Inventor: Shih-Hao Lai, Taichung (TW)

( * ) Notice: Subject to any disclaimer, the term of this patent is extended or adjusted under 35 U.S.C. 154(b) by 165 days.

(21) Appl. No.: 17/035,540

(22) Filed: Sep. 28, 2020

(65) Prior Publication Data

US 2022/0097217 A1 Mar. 31, 2022

(51) Int. Cl.

| | |
|---|---|
| ***B25B 23/14*** | (2006.01) |
| ***B25B 23/00*** | (2006.01) |
| *B25B 23/147* | (2006.01) |
| *B25B 23/145* | (2006.01) |
| *B25B 23/142* | (2006.01) |

(52) U.S. Cl.

CPC ..... *B25B 23/14* (2013.01); *B25B 23/0021* (2013.01); *B25B 23/147* (2013.01); *B25B 23/1425* (2013.01); *B25B 23/1456* (2013.01)

(58) Field of Classification Search

CPC ... B25B 23/142; B25B 23/14; B25B 23/0021; B25B 23/1425; B25B 23/1456; B25B 23/147

See application file for complete search history.

(56) References Cited

U.S. PATENT DOCUMENTS

| | | | | |
|---|---|---|---|---|
| 8,317,350 | B2 * | 11/2012 | Friedman | B25F 5/021 362/120 |
| 2008/0074865 | A1 * | 3/2008 | Lutz | B25B 23/18 362/119 |
| 2019/0314962 | A1 * | 10/2019 | King | B25B 23/1456 |
| 2021/0222866 | A1 * | 7/2021 | Niwa | F21V 33/008 |

* cited by examiner

*Primary Examiner* — Joseph J Hail
*Assistant Examiner* — Robert C Moore

(57) ABSTRACT

An extensive shaft assembly includes a casing, an extensive shaft, a sensor, a warning apparatus, and a connecting apparatus. The extensive shaft extends throughout the casing. The sensor is connected to the extensive shaft. The warning apparatus includes an LED module and a light-guiding ring. The light-guiding ring includes a slit. The LED module is electrically connected to the sensor and located in the slit of the LED module. The connecting apparatus connects the light-guiding ring to the casing so that an external annular portion of the light-guiding ring is visible through a gap between the casing and the connecting apparatus.

6 Claims, 8 Drawing Sheets

WARNING APPARATUS OF AN EXTENSIVE SHAFT FOR A TORQUE TOOL

BACKGROUND OF INVENTION

1. Field of Invention

The present invention relates to an extensive shaft for a torque tool and, more particularly, to a warning apparatus of an extensive shaft for a torque tool.

2. Related Prior Art

A conventional torque tool includes a socket for receiving a nut or a portion of a threaded bolt for example so that the torque tool is operable to tighten or loosen the nut or threaded bolt. However, an extensive shaft might be used between the socket and the nut or threaded bolt if the nut or threaded bolt is in a deep place. A torque indicator can be connected to the extensive shaft to show a value of torque exerted on the extensive shaft to protect the nut or threaded bolt or an object for which the nut or threaded bolt is used. However, the torque indicator could be blocked from a user so that the user is not able to know the torque exerted on the extensive shaft reaches a limit.

The present invention is therefore intended to obviate or at least alleviate the problems encountered in the prior art.

SUMMARY OF INVENTION

It is the primary objective of the present invention to provide a tool with an extensive shaft assembly.

To achieve the foregoing objective, the extensive shaft assembly includes a casing, an extensive shaft, a sensor, a warning apparatus, and a connecting apparatus. The extensive shaft extends throughout the casing. The sensor is connected to the extensive shaft. The warning apparatus includes an LED module and a light-guiding ring. The light-guiding ring includes a slit. The LED module is electrically connected to the sensor and located in the slit of the LED module. The connecting apparatus connects the light-guiding ring to the casing so that an external annular portion of the light-guiding ring is visible through a gap between the casing and the connecting apparatus.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 1:
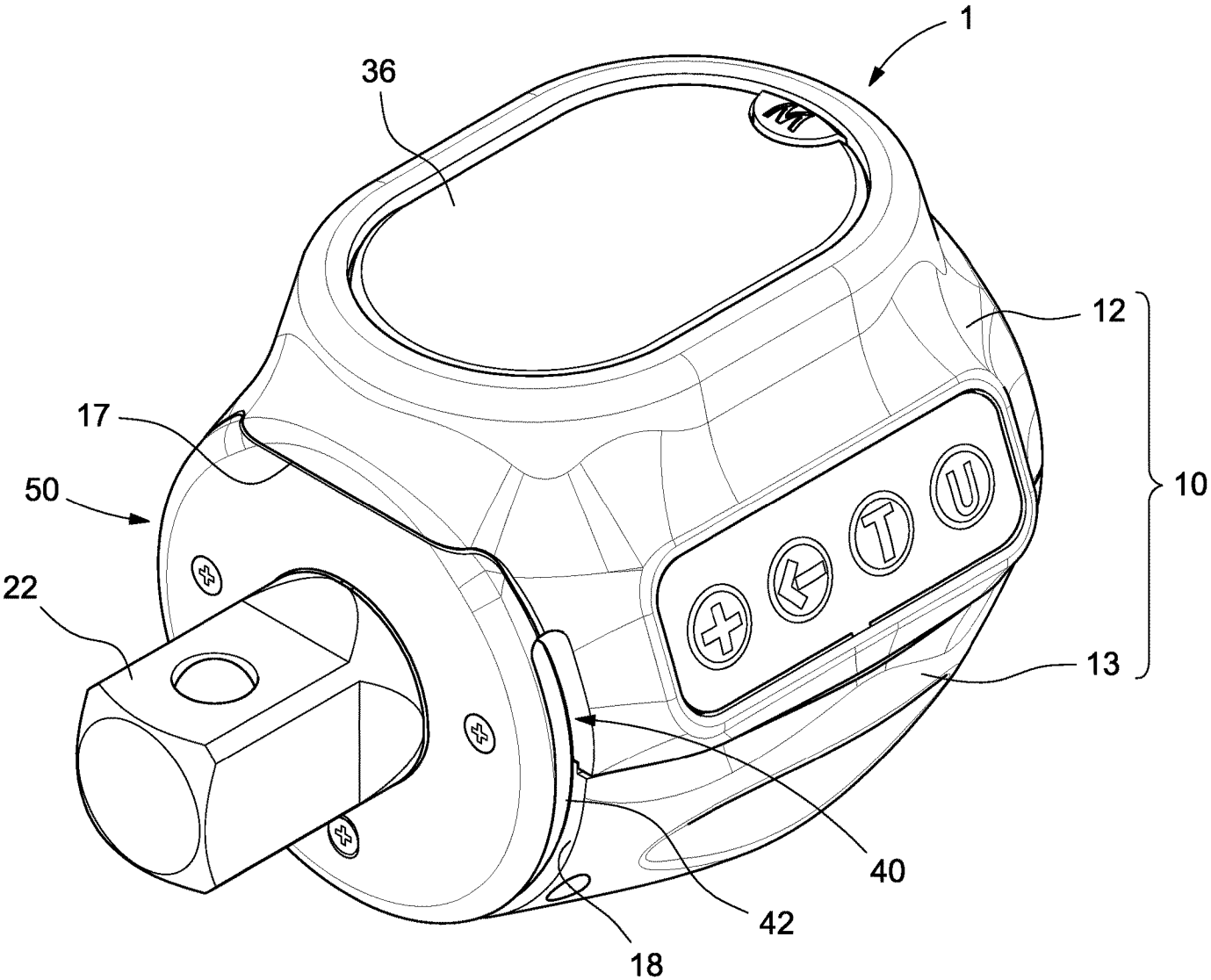
FIG. 1 is a perspective view of an extensive shaft assembly for a torque tool according to the preferred embodiment of the present invention.
Figure 2:
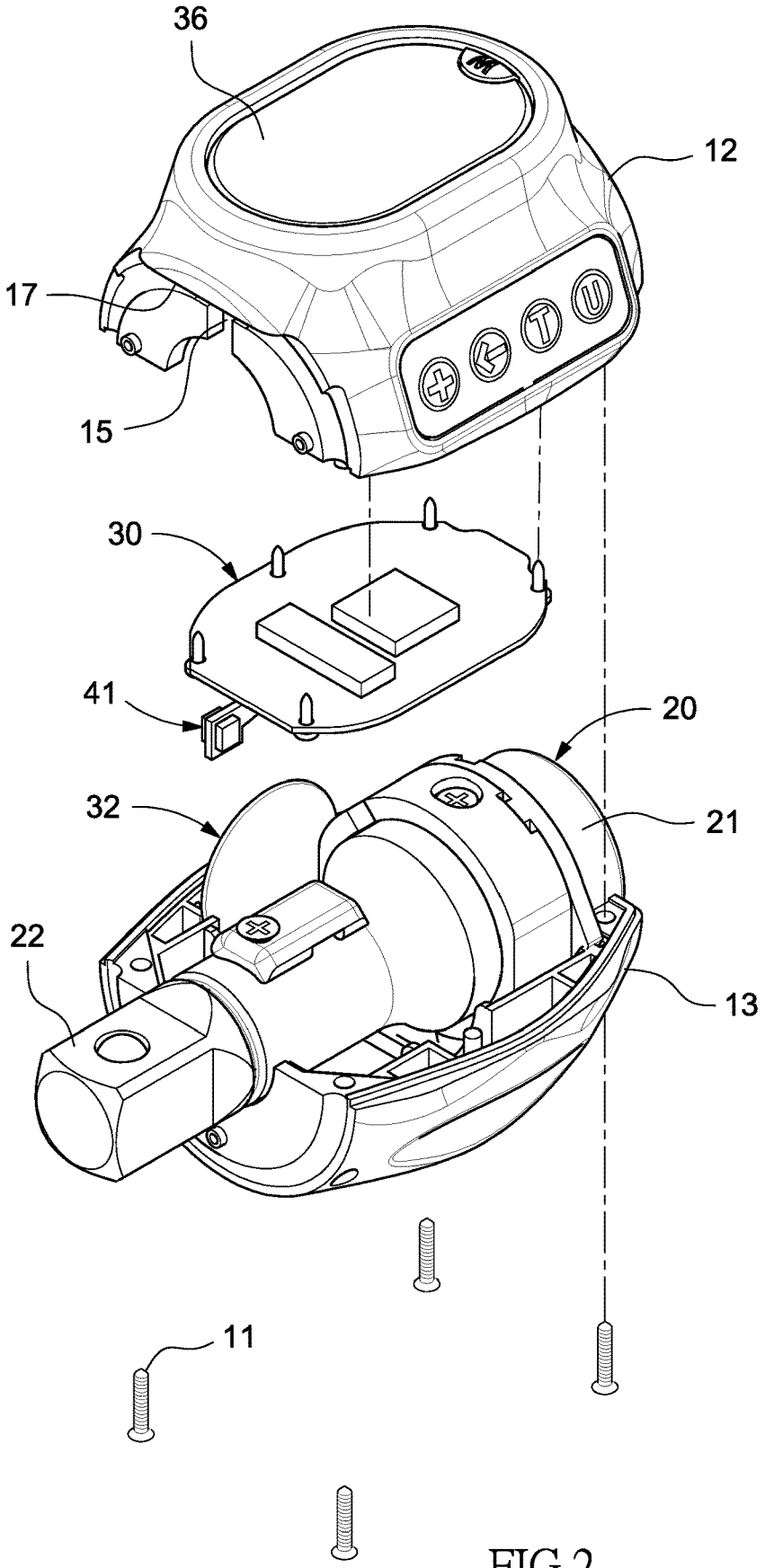
FIG. 2 is an exploded view of the extensive shaft assembly shown in FIG. 1.
Figure 3:
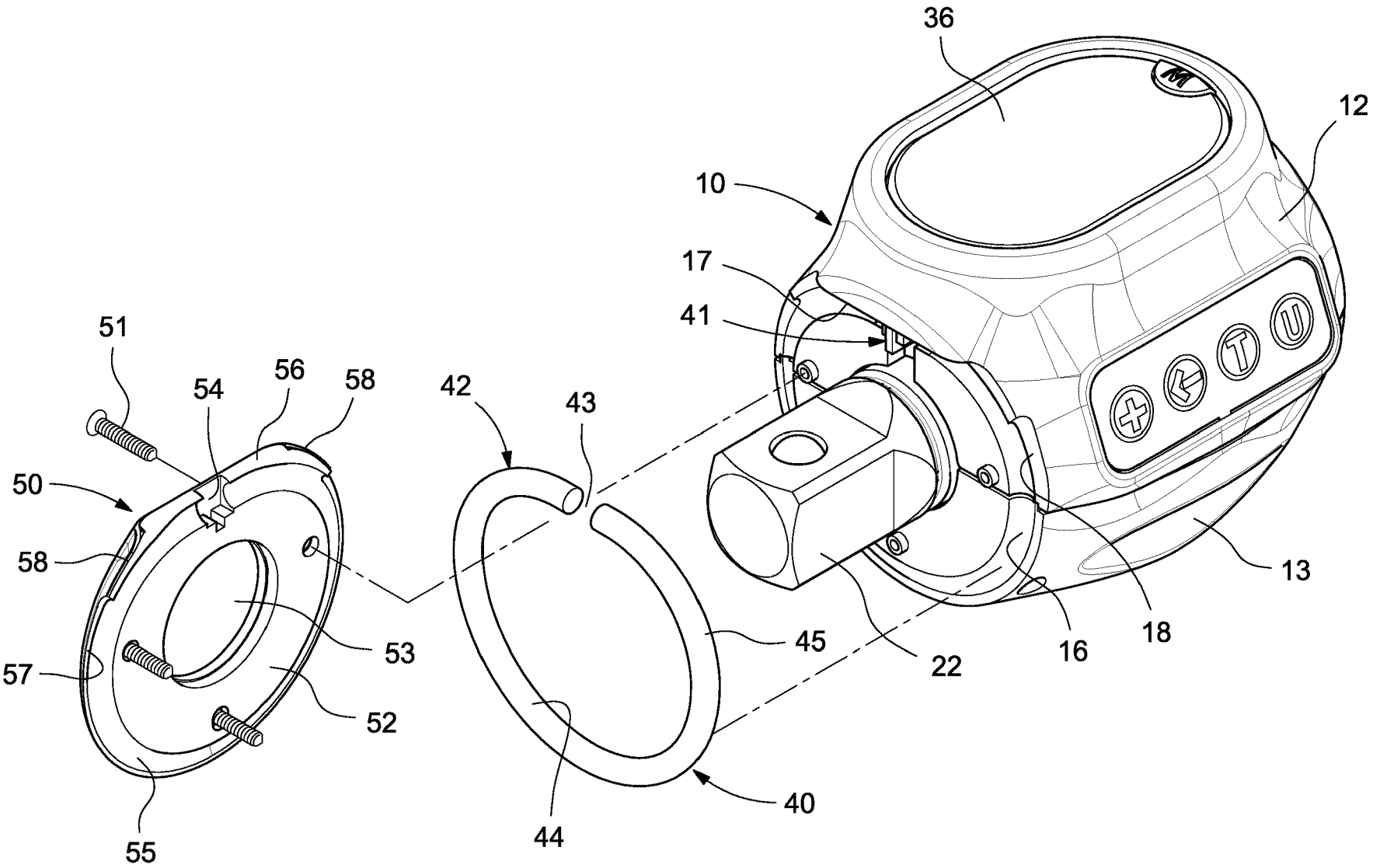
FIG. 3 is another exploded view of the extensive shaft assembly shown in FIG. 1.
Figure 4:
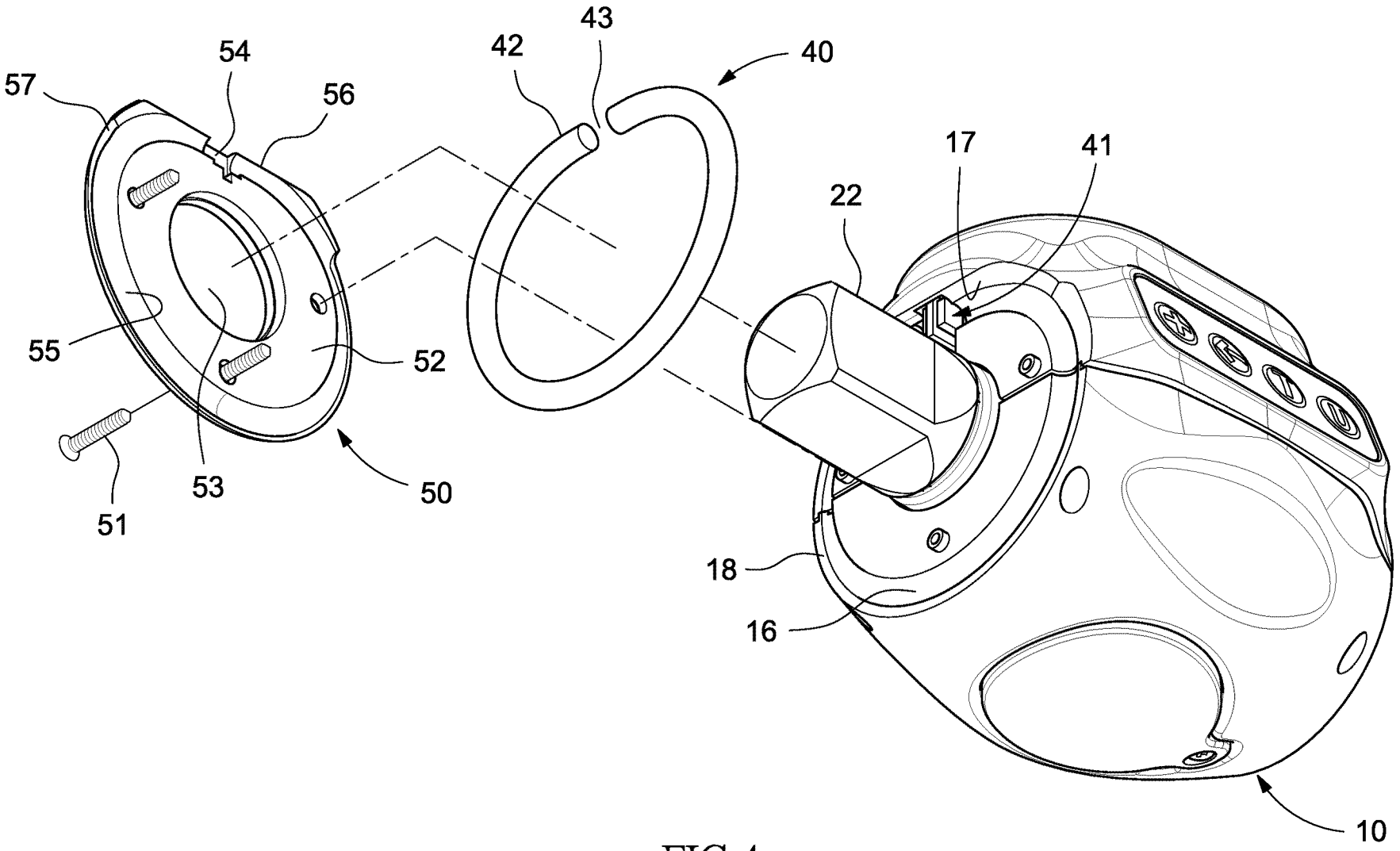
FIG. 4 is another exploded view of the extensive shaft assembly shown in FIG. 1.

Referring to FIGS. 1 through 3, an extensive shaft assembly 1 includes a casing 10, an extensive shaft 20, a sensor 30, a power supply 32, a display 36, and a warning apparatus 40 according to the preferred embodiment of the present invention.

Figure 6:
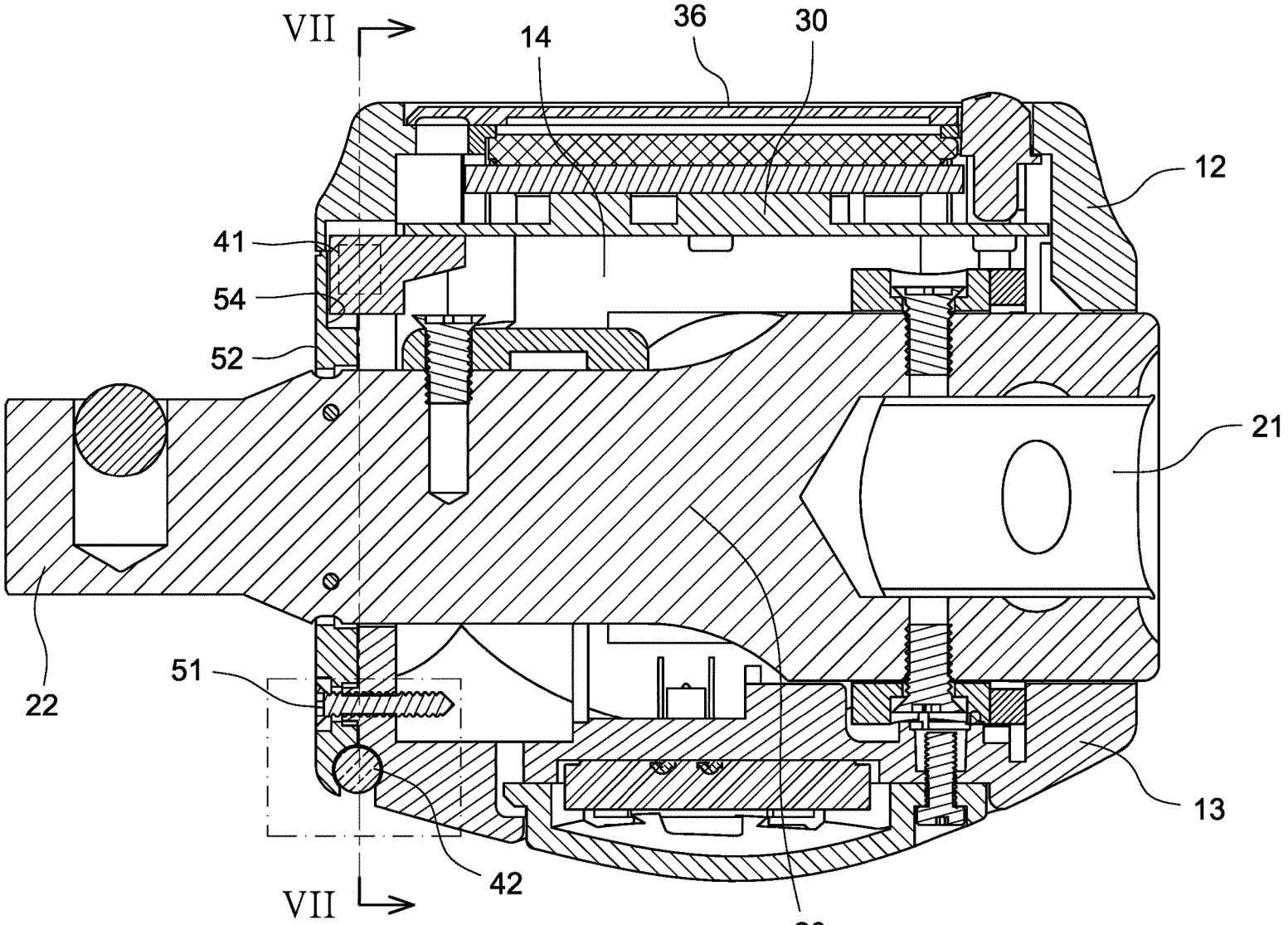
FIG. 6 is a cross-sectional view of the extensive shaft assembly shown in FIG. 5.
Figure 7:
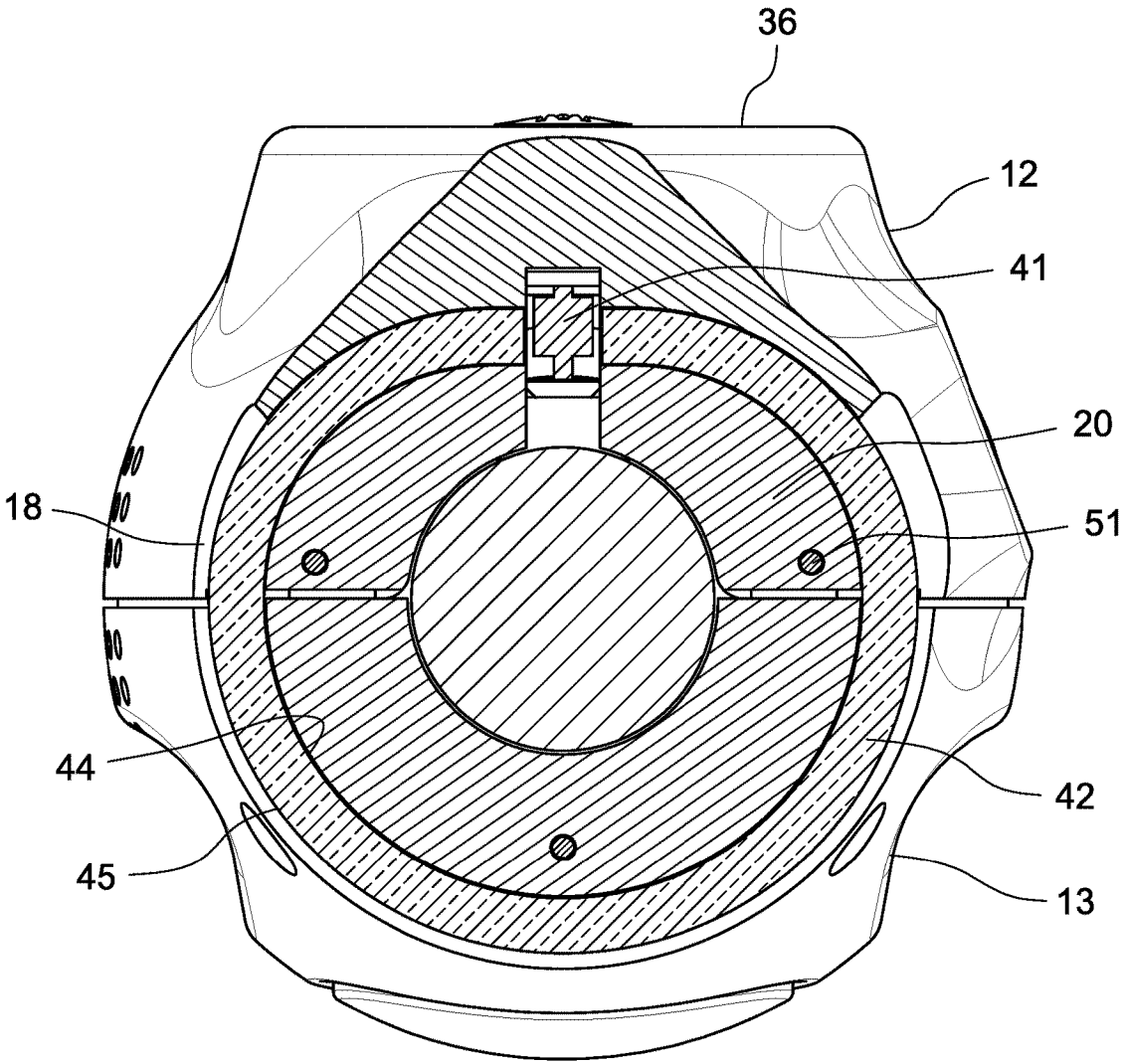
FIG. 7 is a cross-sectional view of the extensive shaft assembly taken along a line VII-VII shown in FIG. 6.
Figure 8:
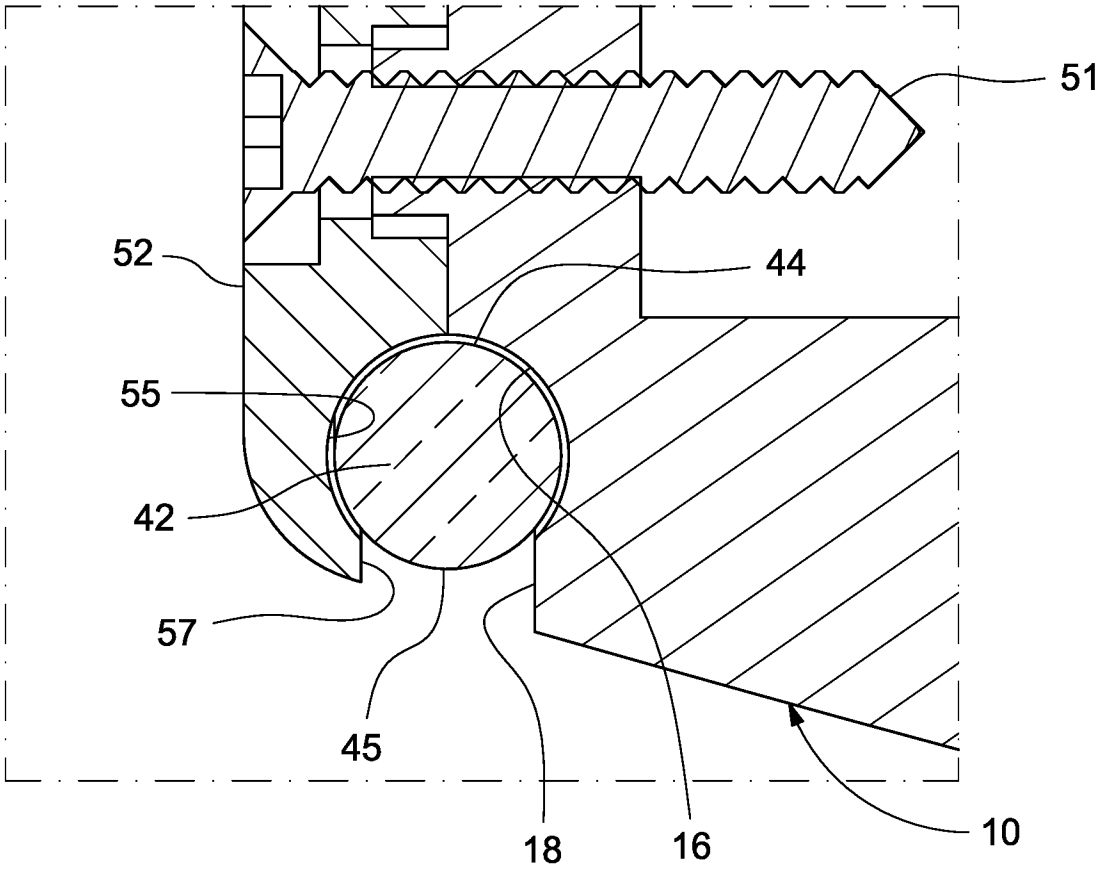
FIG. 8 is an enlarged partial view of the extensive shaft assembly shown in FIG. 6.

The casing 10 includes two shells 12 and 13 connected to each other by several screws 11. The shells 12 and 13 together provide a space 14 (FIG. 6).

The extensive shaft 20 includes a middle section inserted in the space 14. The extensive shaft 20 includes an input portion 21 and an output portion 22. The input portion 21 includes a polygonal cavity such as a square cavity. The input portion 21 is located out of the space 14, behind the casing 10. In use, the polygonal cavity of the input portion 21 receives a corresponding portion of a manual, electric or pneumatic tool (not shown). The output portion 22 is a polygonal portion such as a square portion. The output portion 22 is located out of the space 14, in front of the casing 10. In use, the output portion 22 is inserted in a corresponding cavity of a socket (not shown) and the socket includes another cavity for receiving a nut or a head of a threaded bolt.

The sensor 30 is located in the casing 10. In operation, the sensor 30 detects a value of torque exerted on the extensive shaft 20 and converts the value of torque into a digital signal before sending the digital signal to the display 36 and the warning apparatus 40.

The power supply 32 is preferably a battery, rechargeable or not. The power supply 32 is located in the casing 10. In use, the power supply 32 provides electricity to the sensor 30, the display 36 and the warning apparatus 40.

The display 36 is connected to the first shell 12. In use, the display 36 receives the digital signal from the sensor 30 before showing the value of torque to a user. The electric connection of the sensor 30, the extensive shaft 20, the power supply 32 and the display 36 to one another will not be described in detail as not being the spirit of the present invention.

Referring to FIGS. 4 through 7, the warning apparatus 40 and the connecting apparatus 50 will be described in detail. The warning apparatus 40 includes an LED module 41 and a light-guiding ring 42.

The LED module 41 includes several LED chips (not show) for emitting light of different colors. The LED module 41 is electrically connected to the sensor 30. The sensor 30 instructs the LED module 41 to emit light of one of the colors according to the value of torque. The casing 10 includes a window 15 at a front end. The LED module 41 extends from the casing 10 through the window 15.

The light-guiding ring 42 is a C-shaped element formed with a slit 43. The light-guiding ring 42 is kept at the front end of the casing 10 by the connecting apparatus 50. That is, the light-guiding ring 42 is located between the casing 10 and the connecting apparatus 50. The LED module 41 is located in the slit 43 of the light-guiding ring 42 so that the light emitted from the LED module 41 travels in and along the light-guiding ring 42 before the light-guiding ring 42 radiates the light.

The connecting apparatus 50 includes a cover 52 connected to the front end of the casing 10 by several screws 51. The cover 52 includes an aperture 53 in a center. The output portion 22 of the extensive shaft 20 extends from the casing 10 through the aperture 53 of the cover 52. The cover 52 includes a recess 54 in a rear face, near the periphery. The recess 54 receives the LED module 41.

Referring to FIGS. 3, 4, 6 and 8, the casing 10 includes an annular groove 16 made in the front end. The cover 52 includes an annular groove 55 made in the rear face, corresponding to the annular groove 16. The annular grooves 16 and 55 receive the light-guiding ring 42. The annular grooves 16 and 55 only receive an internal annular portion 44 of the light-guiding ring 42. The annular grooves 16 and 55 do not receive the external annular portion 45 of the light-guiding ring 42.

The casing 10 includes a protrusive portion 17 and a recessed portion 18, located along the annular groove 16. The cover 52 includes a cutout 56, two protrusive portions 58 and a recessed portion 57 between the protrusive portions 58, located along the annular groove 55. The cutout 56 is located between the protrusive portions 58. The recessed portion 57 is located between the protrusive portions 58.

As the cover 52 is connected to the casing 10, the cutout 56 receives the protrusive portion 17, and the protrusive portion 17 is located between the protrusive portions 58. The protrusive portions 17 and 58 cover the LED module 41 and a small portion of the light-guiding ring 42. The recessed portions 18 and 57 together become a gap 60 (FIG. 6) between the casing 10 and the cover 52. A large portion of the external annular portion 45 of the light-guiding ring 42 is visible through the gap 60. Preferably, the protrusive portions 17 and 58 together cover about one fourth of the external portion of the light-guiding ring 42 about the slit 43. The gap 60 exposes the remaining three fourths of the external annular portion of the light-guiding ring 42. The protrusive portions 17 and 58 and the display 36 are located on a same side of the extensive shaft assembly 1 to cover the LED module 41 and block a portion of the light emitted from the light-guiding ring 42 not to interfere with observation of the value of torque shown on the display 36.

Figure 5:
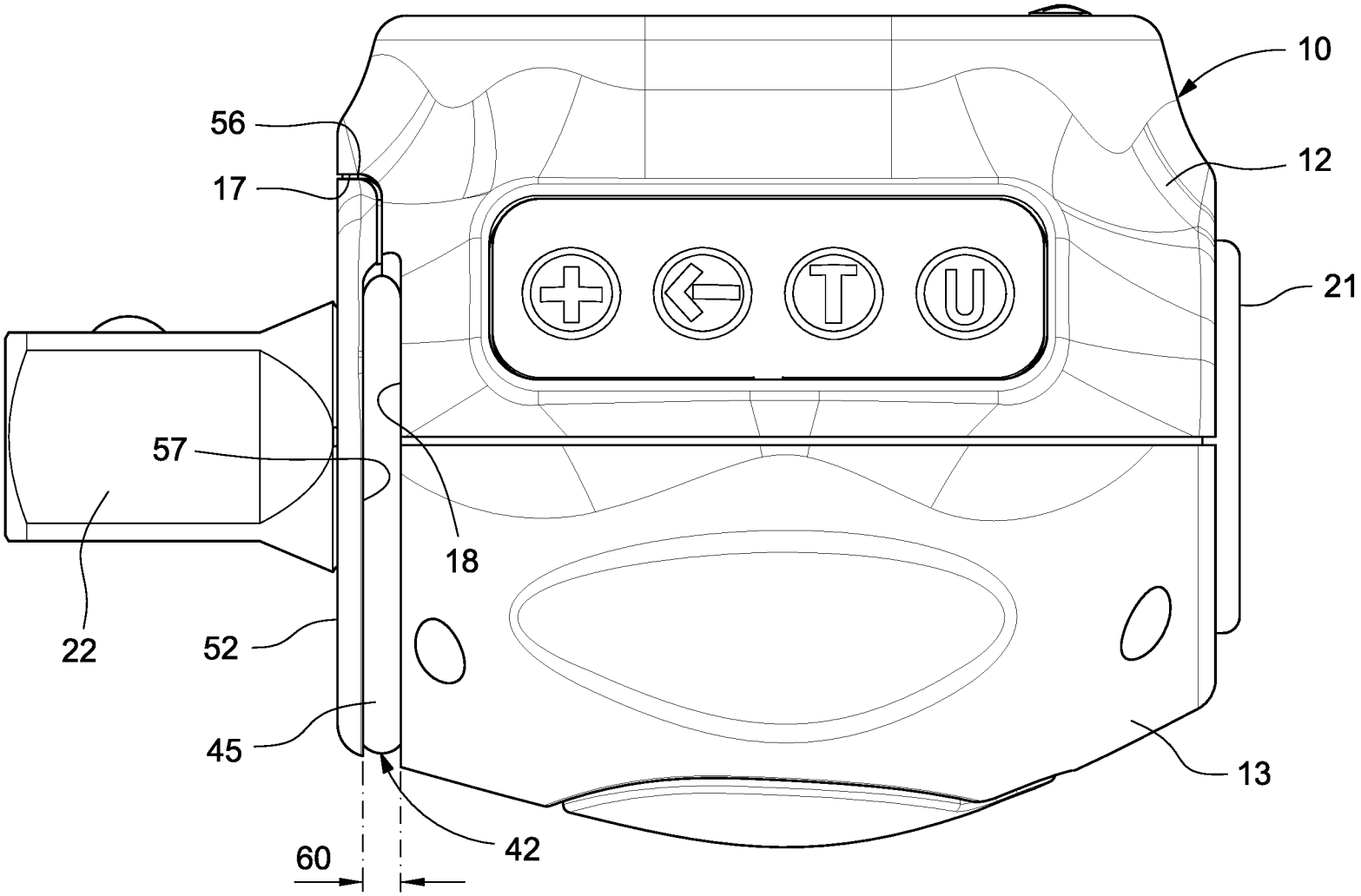
FIG. 5 is a side view of the extensive shaft assembly shown in FIG. 1.

Referring to FIGS. 1, 5 and 6, the annular grooves 16 and 55 receive the light-guiding ring 42 to keep the light-guiding ring 42 between the casing 10 and the cover 52. The external annular portion 45 of the light-guiding ring 42 does not extend beyond the periphery of the casing 10 and the periphery of the cover 52. Thus, the light-guiding ring 42 is protected by the casing 10 and the cover 52. That is, the light-guiding ring 42 will not be hit when the extensive shaft assembly 1 is used. However, the light emitted from the light-guiding ring 42 is visible through a gap between the recessed portions 18 and 57.

In use, the sensor 30 detects the value of torque exerted on the extensive shaft 20 and converts the value of torque into the digital signal. The display 36 receives the digital signal from the sensor 30 and accordingly shows the value of torque. The sensor 30 instructs the LED module 41 to emit light of one of the colors according to the value of torque. For example, the sensor 30 instructs the LED module 41 to emit green light if the value of torque is smaller than the limit in a case where the nut or threaded bolt is loosened. The sensor 30 instructs the LED module 41 to emit yellow light if the value of torque approaches the limit in a case where the nut or threaded bolt is tightened. The sensor 30 instructs the LED module 41 to emit red light if the value of torque is equal to or larger than the limit in a case where the nut or threaded bolt is properly or excessively tightened. If possible, the user can turn the display 36 to an angle where the display 36 is visible to the user. Alternatively, the user can observe the color of the light emitted from the light-guiding ring 42 to know whether the value of torque exerted on the extensive shaft 20 reaches the limit if it is not possible to turn the display 36 to an angle where the display 36 is visible to the user The present invention has been described via the illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. An extensive shaft assembly comprising:

a casing (10) comprising a protrusive portion (17) extending along an external edge thereof;

an extensive shaft (20) extending throughout the casing (10);

a sensor (30) connected to the extensive shaft (20);

a warning apparatus (40) comprising:

a light-guiding ring (42) comprising a slit (43), an internal annular portion (44) and an external annular portion (45); and an LED module (41) electrically connected to the sensor (30) and located in the slit (43) of the light-guiding ring (42); and a cover (52) connected to the casing (10) so that there is a gap (60) between the casing (10) and the cover (52) and that the external annular portion (45) of the light-guiding ring (42) is visible through the gap (60) between the casing (10) and the cover (52), wherein the cover (52) comprises two protrusive portions (58) extending along an external edge of the cover (52) and a cutout (56) located between the protrusive portions (58) of the cover (52), wherein the protrusive portion (17) of the casing (10) is inserted in the cutout (56) of the cover (52), and wherein the LED module (41) is shielded by the protrusive portion (17) of the casing (10) and the protrusive portions (58) of the cover (52).

2. The extensive shaft assembly according to claim 1, wherein the cover (52) comprises an aperture (53), wherein the extensive shaft (20) comprises an output portion (22) extending from the casing (10) through the aperture (53).

3. The extensive shaft assembly according to claim 1, wherein the casing (10) comprises an annular groove (16), wherein the cover (52) comprises an annular groove (55), wherein the annular grooves (16, 55) together receive the internal annular portion (44) of the light-guiding ring (42).

4. The extensive shaft assembly according to claim 3, the casing (10) further comprises a recessed portion (18) extending along the annular groove (16) of the casing (10), wherein the cover (52) further comprises a recessed portion (57) extending along the annular groove (55) of the cover (52), wherein the recessed portions (18, 57) together provide the gap (60) between the casing (10) and the cover (52), wherein the external annular portion (45) of the light-guiding ring (42) is visible through the gap (60).

5. The extensive shaft assembly according to claim 1, wherein the protrusive portions (58) of the cover (52) and the protrusive portion (17) of the casing (10) together cover one fourth of the external annular portion (45) of the light-guiding ring (42) in the vicinity of the slit (43), wherein the gap (60) exposes the remaining three fourths of the external annular portion (45) of the light-guiding ring (42).

6. The extensive shaft assembly according to claim 1, further comprising a display (36) electrically connected to the sensor (30), wherein the protrusive portions (58) of the cover (52), the protrusive portion (17) of the casing (10) and the display (36) are located on a same side of the extensive shaft assembly (1).

* * * * *